US009178323B2

(12) United States Patent
Ju

(10) Patent No.: US 9,178,323 B2
(45) Date of Patent: Nov. 3, 2015

(54) ELECTRICAL CONNECTOR

(71) Applicant: LOTES CO., LTD, Keelung (TW)

(72) Inventor: Ted Ju, Keelung (TW)

(73) Assignee: LOTES CO., LTD., Keelung (TW)

( * ) Notice: Subject to any disclaimer, the term of this patent is extended or adjusted under 35 U.S.C. 154(b) by 29 days.

(21) Appl. No.: 14/157,880

(22) Filed: Jan. 17, 2014

(65) Prior Publication Data

US 2015/0050844 A1 Feb. 19, 2015

(30) Foreign Application Priority Data

Aug. 14, 2013 (CN) ..... 2013 2 0495056 U

(51) Int. Cl.
*H01R 24/58* (2011.01)
*H01R 12/72* (2011.01)

(52) U.S. Cl.
CPC ..... *H01R 24/58* (2013.01); *H01R 12/722* (2013.01)

(58) Field of Classification Search
CPC ..... H01R 13/428; H01R 13/111
USPC ..... 439/682, 744, 669, 668, 83, 188
See application file for complete search history.

(56) References Cited

U.S. PATENT DOCUMENTS 6,312,274 B1 * 11/2001 Lin ..... H01R 24/58 439/188
6,575,793 B1 * 6/2003 Li ..... H01R 24/58 439/188
6,690,801 B2 * 2/2004 Yeh ..... H01R 24/58 381/77
6,808,404 B1 * 10/2004 Doyle ..... H01R 13/7031 200/51.1
7,147,497 B1 * 12/2006 Liao ..... H01R 13/7031 200/51.1
7,238,059 B1 * 7/2007 Wu ..... H01R 13/41 439/688
7,285,024 B1 * 10/2007 Tai ..... H01R 12/707 439/188
7,470,153 B2 * 12/2008 Han ..... H01R 24/58 439/669
7,568,929 B1 * 8/2009 Su ..... H01R 13/7033 439/188
7,645,170 B2 * 1/2010 Long ..... H01R 13/5202 439/668
7,717,755 B2 * 5/2010 Zhang ..... H01R 24/58 439/669
7,775,837 B2 * 8/2010 Zhang ..... H01R 13/6277 439/669
7,785,119 B1 * 8/2010 Chiang ..... H01R 13/7036 439/188
7,901,251 B1 * 3/2011 Chen ..... H01R 13/7032 439/668
8,221,138 B2 * 7/2012 Lin ..... H01R 24/58 439/744
8,602,801 B2 * 12/2013 Sylvester ..... H01R 13/6485 439/188
8,772,654 B2 * 7/2014 Tziviskos ..... H01R 13/7033 200/51.09
2008/0318457 A1 * 12/2008 Li ..... H01R 24/58 439/188
2009/0149080 A1 * 6/2009 Wu ..... H01R 12/57 439/668
2010/0055979 A1 * 3/2010 Wang ..... H01R 24/58 439/607.01
2010/0144213 A1 * 6/2010 Lin ..... H01R 24/58 439/744

(Continued)

*Primary Examiner* — Abdullah Riyami
*Assistant Examiner* — Nader J Alhawamdeh
(74) *Attorney, Agent, or Firm* — Locke Lord LLP; Tim Tingkang Xia, Esq.

(57) ABSTRACT

An electrical connector includes an insulating body, an insulating arm, a movable terminal, and a fixed terminal. The insulating body has an insertion hole concavely formed from its front end surface, and a first receiving slot formed at a side of and in communication with the insertion hole. The insulating arm extends from the insulating body and has an extending portion partially entering the insertion hole. The movable terminal has a first fixing portion fixed in the insulating body, an elastic arm extending backward from the first fixing portion and located between the insertion hole and the insulating arm, and a first contact portion extending backward from the elastic arm. The first contact portion crosses the insulating arm, and is located at a side of the insulating arm away from the insertion hole. The fixed terminal has a second contact portion capable of connecting/disconnecting from the first contact portion.

15 Claims, 7 Drawing Sheets

(56) References Cited

U.S. PATENT DOCUMENTS

2011/0104956 A1* 5/2011 Guo ..... H01R 12/57 439/668
2011/0183536 A1* 7/2011 Wang ..... H01R 24/58 439/188
2014/0073158 A1* 3/2014 Hong ..... H01R 13/5202 439/188

* cited by examiner

ELECTRICAL CONNECTOR

CROSS-REFERENCE TO RELATED APPLICATION

This non-provisional application claims priority under 35 U.S.C. §119(a) on Patent Application No. 201320495056.X filed in P.R. China on Aug. 14, 2013, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates generally to an electrical connector, and particularly to an audio electrical connector having a switch terminal.

BACKGROUND OF THE INVENTION

Currently, audio connectors are frequently used in the industry, such as, an audio socket connector disclosed in Chinese patent No. CN201220509738.7. The audio socket connector is internally provided with an insulating body, and the middle of the insulating body has a circular insertion hole for a mating audio plug to be inserted therein. Multiple signal terminals and a pair of switch terminals are arranged around the circular insertion hole. The switch terminals include a movable terminal and a fixed terminal. The insulating body is provided with an insulating arm. The insulating arm is located between the insertion hole and the movable terminal. The fixed terminal is located at a side of the movable terminal away from the insulating arm. In an initial state, the movable terminal and the fixed terminal do not contact. When the mating audio plug is inserted into the circular insertion hole, the mating audio plug butts the insulating arm to push the movable terminal to move toward the fixed terminal, and finally make the movable terminal press against the fixed terminal, so that the switch terminals are switched on, thereby implementing a switch function.

The insulating body is provided with the circular insertion hole in the longitudinal direction, and the insulating arm extends backward tightly along the edge of the circular insertion hole. However, as electronic products are required to be light, thin, and small, the length of the audio socket connector is limited, and the insulating arm convexly arranged in the insulating body cannot be extended to be excessively long. Thus, when the mating audio plug butts the insulating arm, it is required to push the movable terminal to contact or be away from the fixed terminal. Therefore, the insulating arm is easily broken due to insufficient elasticity.

Therefore, to arrange a long insulating arm and movable terminal in a limited space becomes a problem to be solved.

SUMMARY OF THE INVENTION

In one aspect, the present invention is directed to an electrical connector with a long insulating arm arranged in a limited space.

In one embodiment, an electrical connector includes an insulating body, an insulating arm, a movable terminal, and a fixed terminal. A front end surface of the insulating body is concavely provided with an insertion hole. A side of the insertion hole is provided with a first receiving slot, and the first receiving slot and the insertion hole are in communication with each other. The insulating arm extends backward from a front inner wall surface of the first receiving slot, and has an extending portion partially entering the insertion hole. The movable terminal has a first fixing portion fixed in the insulating body, an elastic arm extending backward from the first fixing portion. The elastic arm is located between the insertion hole and the insulating arm. A first contact portion extends backward from the elastic arm. The first contact portion crosses the insulating arm, and is located at a side of the insulating arm away from the insertion hole. The fixed terminal has a second contact portion capable of keeping in contact with or disconnecting from the first contact portion.

In one embodiment, the first fixing portion is fixed in the first receiving slot.

In one embodiment, the insulating arm has a base portion extending from a front inner wall surface of the first receiving slot, the base portion has an extending portion extending backward obliquely, and the extending portion extends into the insertion hole.

In one embodiment, a groove is arranged on the insulating arm, and the elastic arm passes through the insulating arm from the inside of the groove and is limited by the groove, so that the elastic arm is capable of moving along with the insulating arm.

In one embodiment, the distance between the first contact portion and the first fixing portion is greater than the length of the insulating arm.

In one embodiment, at least one bending portion is arranged on the elastic arm or the first contact portion.

In one embodiment, multiple signal terminals are further included. Each of the signal terminals is the same, and the signal terminals and the movable terminal are located at two opposite sides of the insulating body separately.

In another aspect, the present invention is directed to an electrical connector.

In one embodiment includes an insulating body, a movable terminal, a fixed terminal, and multiple signal terminals. The insulating body is internally provided with at least one first receiving slot, and the first receiving slot is internally and convexly provided with an insulating arm. The movable terminal has a first fixing portion fixed in the first receiving slot, an elastic arm extending backward from the first fixing portion, and a first contact portion located at a back end of the elastic arm. The elastic arm passes through the insulating arm, and is capable of moving along with the insulating arm. The fixed terminal has a second contact portion capable of contacting the first contact portion. The multiple signal terminals are arranged in the insulating body.

In one embodiment, the insulating body is provided with an insertion hole. The first receiving slot and the insertion hole are in communication with each other. The insulating arm has a base portion extending from a front inner wall surface of the first receiving slot. The base portion has an extending portion extending backward obliquely, and the extending portion extends into the insertion hole.

In one embodiment, the elastic arm is located between the insulating arm and the insertion hole, and the first contact portion crosses the insulating arm and is located at a side of the insulating arm away from the insertion hole.

In one embodiment, a groove is arranged on the insulating arm, and the elastic arm passes through the insulating arm from the inside of the groove and is limited by the groove, so that the elastic arm is capable of moving along with the insulating arm.

In one embodiment, the elastic arm is located at an inner side of the insulating arm, and the elastic arm extends backward from the first fixing portion, crosses the extending portion and extends to an outer side of the insulating arm.

In one embodiment, the distance between the first contact portion and the first fixing portion is greater than the length of the insulating arm.

In one embodiment, at least one bending portion is arranged on the elastic arm.

In one embodiment, the signal terminals are all the same, and located at a same side of the insulating body.

As compared with the related art, certain embodiments of the present invention, among other things, have the following beneficial advantages.

The insulating arm extends backward from the front inner wall surface of the first receiving slot, the extending portion partially enters the insertion hole, the elastic arm is located between the insertion hole and the insulating arm, a first contact portion extends backward from the elastic arm, and the first contact portion crosses the insulating arm and is located at a side of the insulating arm away from the insertion hole. That is to say, the insulating arm extends backward, passes through the elastic arm and enters the insertion hole, so in the limited space of the first receiving slot, the length of the insulating arm is extended to be large. Therefore, the elasticity of the insulating arm is good, and the insulating arm is not easily broken after being inserted multiple times. Thereby, it can be ensured that after the mating plug is inserted into the insertion hole, the insulating arm is pushed so as to further push the movable terminal to contact or disconnect from the fixed terminal.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
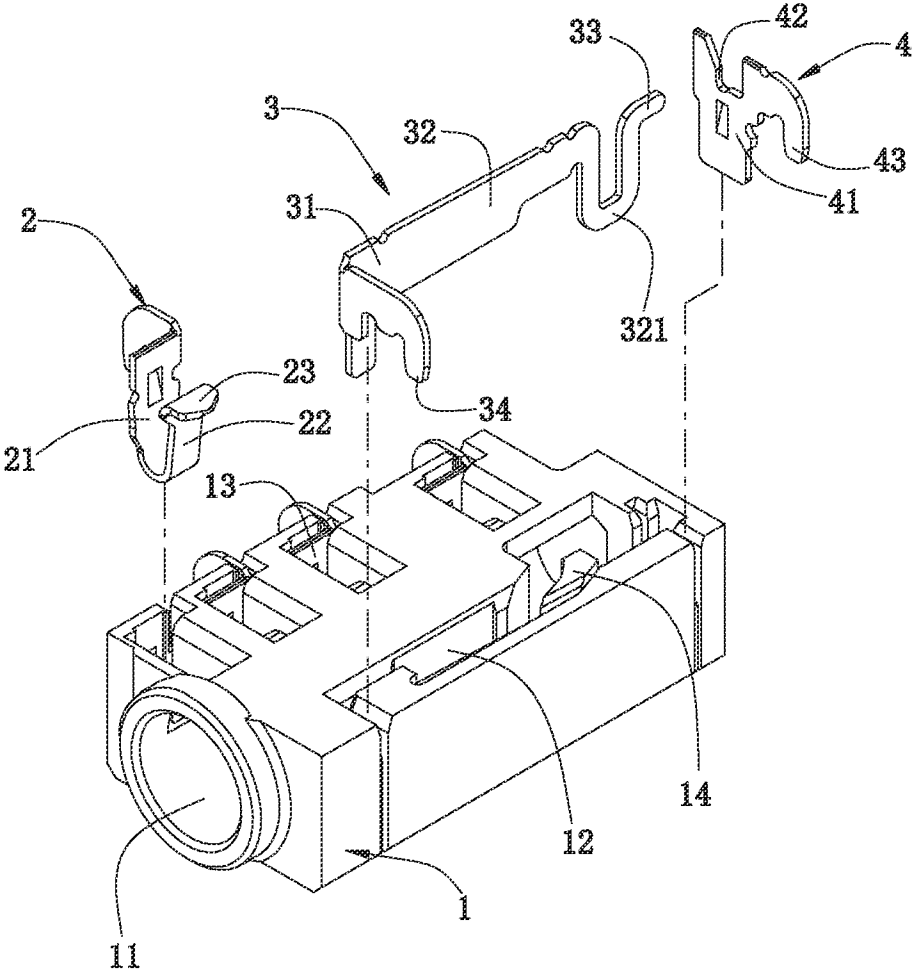
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

As shown in FIG. 1, an electrical connector 100 according to one embodiment of the present invention includes an insulating body 1, multiple signal terminals 2, and a pair of switch terminals arranged in the insulating body 1.

Figure 3:
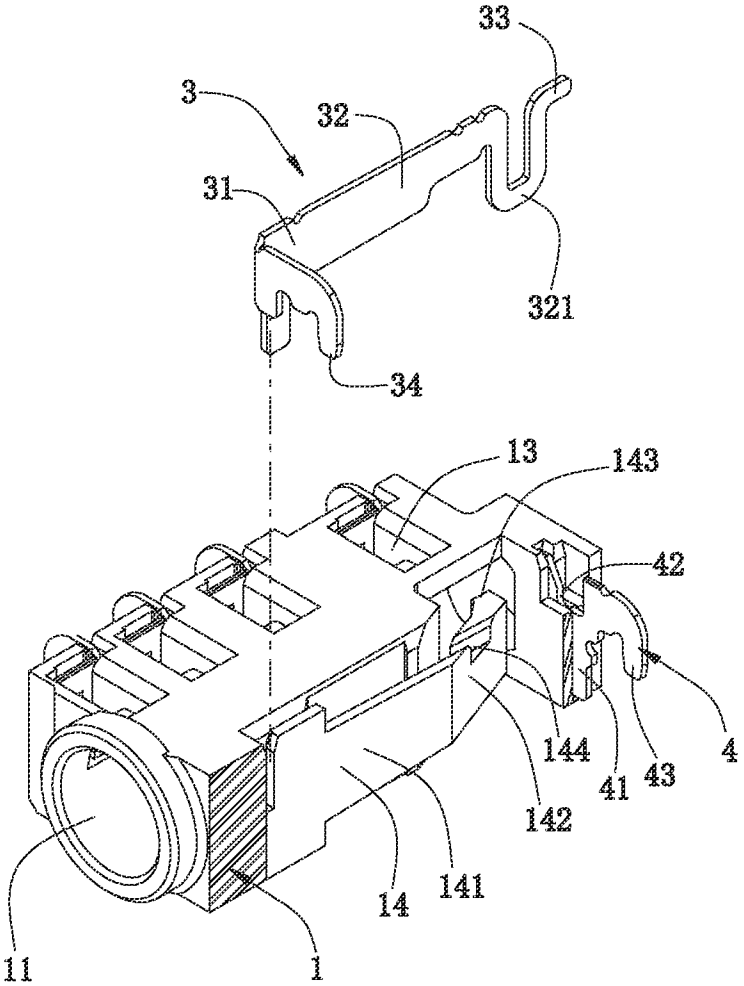
FIG. 3 is a schematic three-dimensional view of the electrical connector having no movable terminal mounted according to one embodiment of the present invention.
Figure 6:
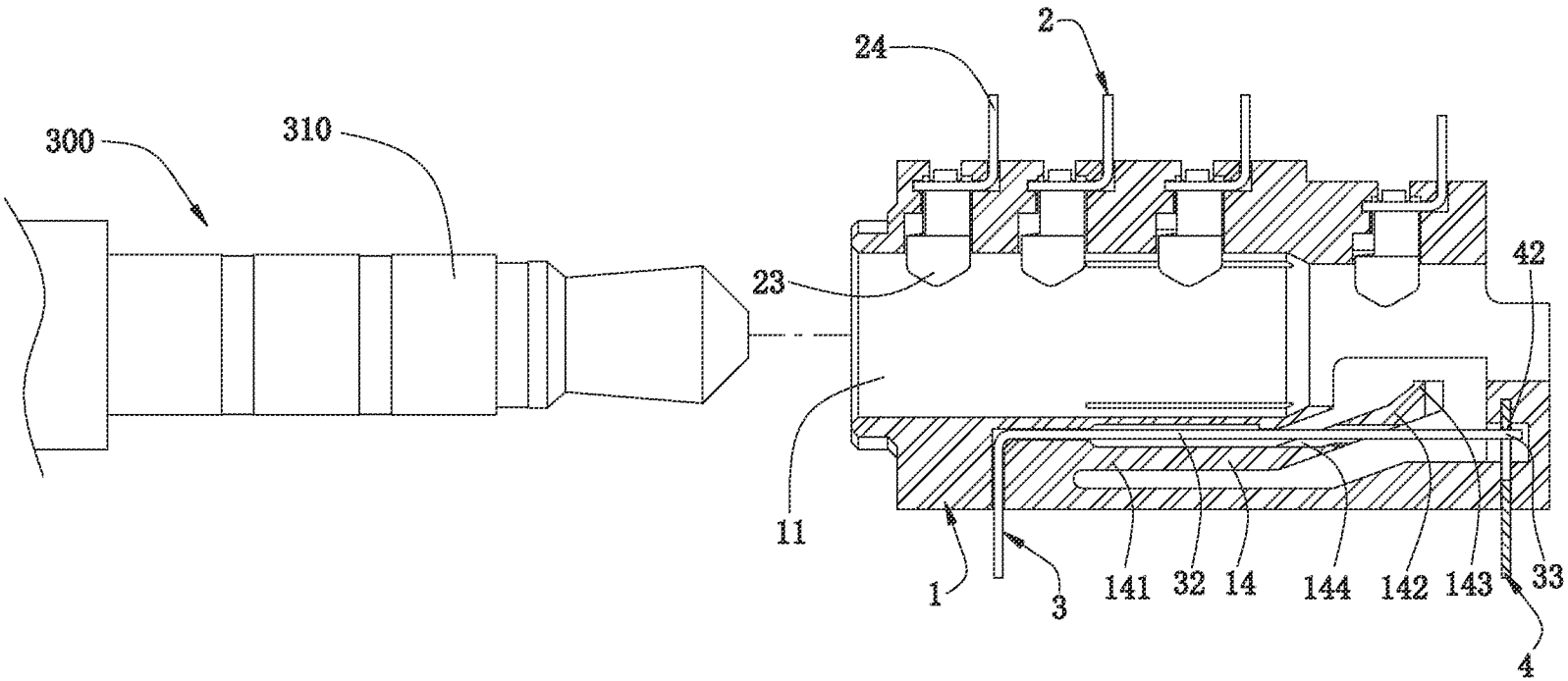
FIG. 6 is a schematic sectional view where an audio plug is not inserted into the electrical connector according to one embodiment of the present invention.

As shown in FIG. 1, FIG. 3 and FIG. 6, the insulating body 1 has a circular insertion hole 11. The insertion hole 11 is concavely arranged backward from the front end of the insulating body 1 and runs through the insulating body 1. One side of the insertion hole 11 is disposed with a first receiving slot 12 accommodating the switch terminals. The other side of the insertion hole 11 is disposed with multiple second receiving slots 13 accommodating the signal terminals 2. The first receiving slot 12 and the second receiving slots 13 are both in communication with the insertion hole 11. A front inner wall surface of the first receiving slot 12 is backward and convexly provided with an insulating arm 14. The insulating arm 14 has a base portion 141 and an extending portion 142. The extending portion 142 extends backward and obliquely from the base portion 141, and enters the insertion hole 11. An end of the extending portion 142 is provided with a resisting portion 143. A groove 144 is arranged on the extending portion 142. The multiple second receiving slots 13 and the first receiving slot 12 are separately located at two opposite sides of the insertion hole 11. In this embodiment, a number of the second receiving slots 13 is four. The four second receiving slots 13 are arranged into a row, and located at a side of the insertion hole 11. The first receiving slot 12 is located at another side of the insertion hole 11. Thus, the first receiving slot 12 may be arranged to be long, and the insulating arm 14 may also be long so that the elasticity is good.

Figure 2:
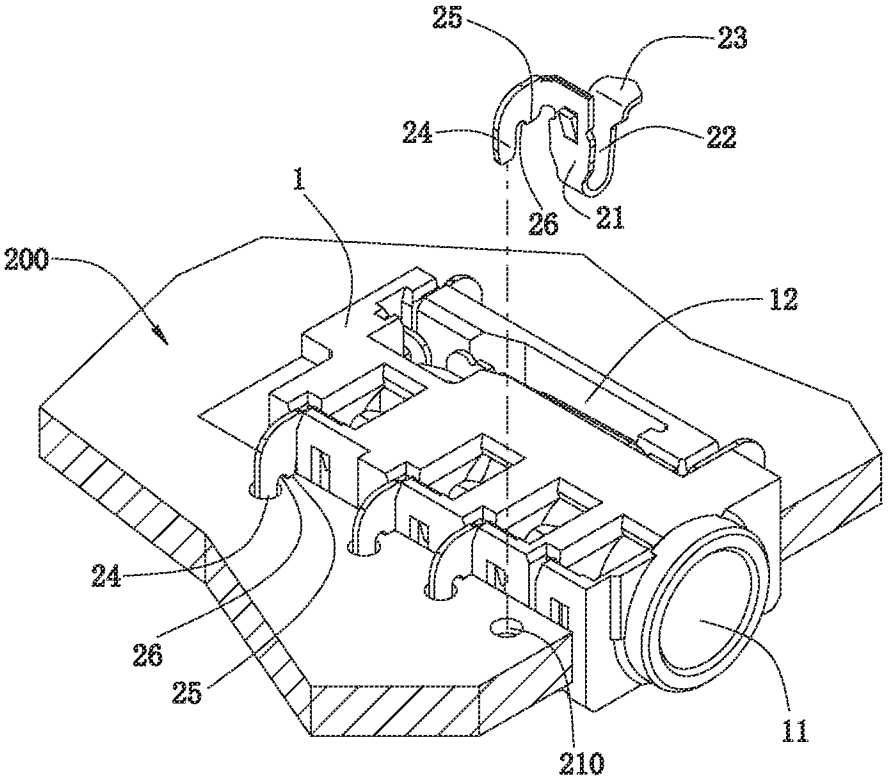
FIG. 2 is a schematic three-dimensional view of the electrical connector viewed from another angle according to one embodiment of the present invention.

As shown in FIG. 1 and FIG. 2, a number of the signal terminals 2 is four. The four signal terminals 2 are all arranged at a same side of the insertion hole 11, and each of the signal terminals 2 is mounted in a corresponding second receiving slot 13. Each of the signal terminals 2 is the same in shape, so during manufacturing, only a set of die may be formed, thereby lowering the cost. The signal terminal 2 has a vertical fixing portion 21 for being fixed in the second receiving slot 13. A lower end of the fixing portion 21 is folded upward and extended with an elastic portion 22. The elastic portion 22 is approximately in parallel with the fixing portion 21. An end of the elastic portion 22 is convexly provided with a contact portion 23 convexly extending into the insertion hole 11. An upper end side edge of the fixing portion 21 is folded to pass through a side wall of the insulating body 1, and extended downward with a welding portion 24. An abutting portion 25 is arranged between the welding portion 24 and the fixing portion 21, and a notch 26 is arranged between the abutting portion 25 and the welding portion 24. When the welding portion 24 is welded to a circuit board 200, the abutting portion 25 butts the circuit board 200, and the notch 26 may be used for inflow of a solder (not shown in the drawing) at the welding portion 24, so as to prevent climbing.

Figure 4:
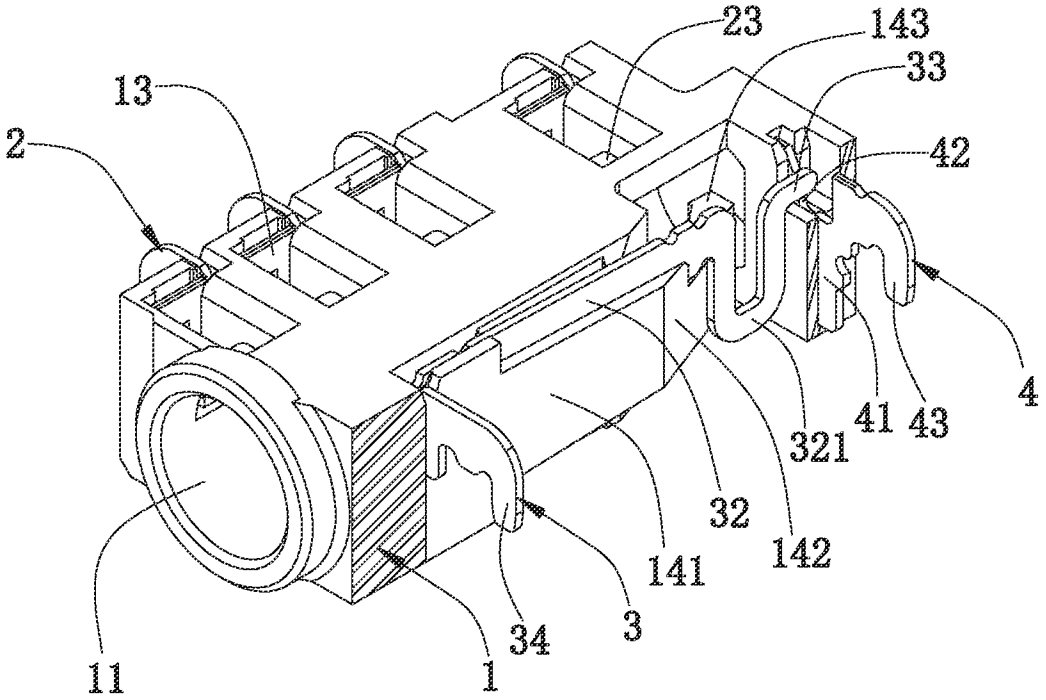
FIG. 4 is a schematic three-dimensional assembly drawing of the electrical connector having a terminal mounted into an insulating body according to one embodiment of the present invention.
Figure 5:
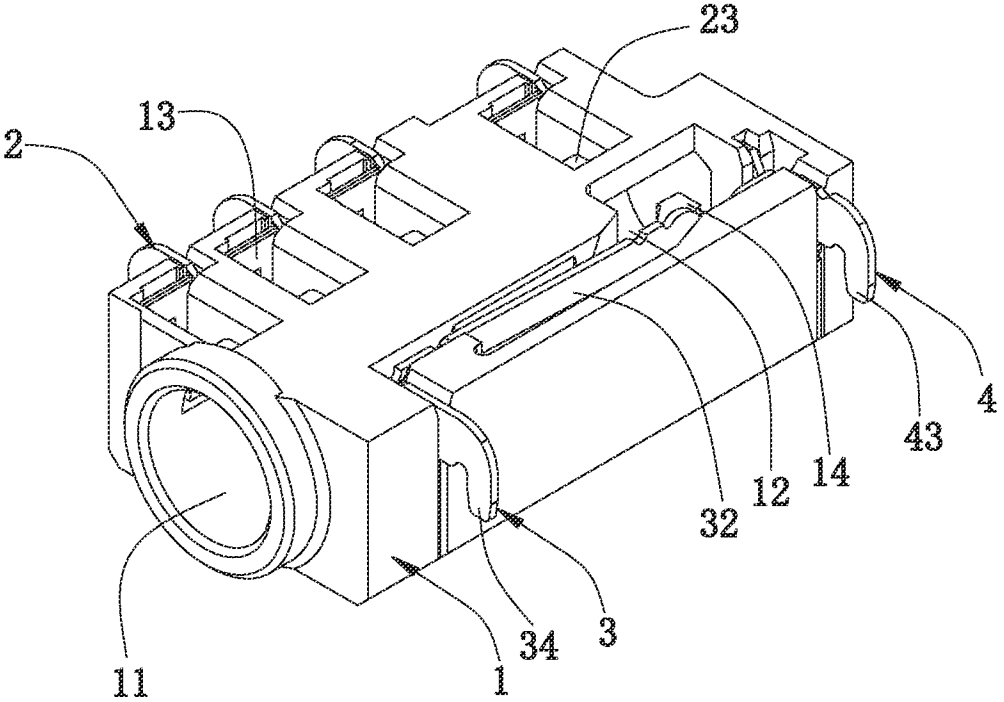
FIG. 5 is a schematic three-dimensional assembly view of an electrical connector according to one embodiment of the present invention.

As shown in FIG. 1, FIG. 3 and FIG. 4, the switch terminals include a movable terminal 3 and a fixed terminal 4 arranged opposite to each other. The movable terminal 3 has a first fixing portion 31 fixed in the first receiving slot 12, an elastic arm 32 extending backward from the first fixing portion 31, and a first contact portion 33 extending backward from the elastic arm 32. The elastic arm 32 is located between the insulating arm 14 and the insertion hole 11, namely, the elastic arm 32 is located at the inner side of the insulating arm 14. The first contact portion 33 is located at a side of the insulating arm 14 away from the insertion hole 11, namely, the first contact portion 33 is located at the outer side of the insulating arm 14. Thus, the insulating arm 14 extends to the inner side of the elastic arm 32 from the outer side of the elastic arm 32, and extends into the insertion hole 11 obliquely, so in the limited space of the first receiving slot 12, the insulating arm 14 may be long, so that the elasticity of the insulating arm 14 is good. The first contact portion 33 extends backward from an end of the elastic arm 32, and the first contact portion 33 and the first fixing portion 31 are separately located at two opposite sides of the insulating arm 14. The distance between the first contact portion 33 and the first fixing portion 31 is greater than the length of the insulating arm 14, namely, the first contact portion 33 is away from the resisting portion 143 backward. The elastic arm 32 passes through the insulating arm 14 from the inside of the groove 144, and is limited by the groove 144, so that the elastic arm 32 is capable of moving along with the insulating arm 14. At least one bending portion 321 is further arranged on the elastic arm 32 or the first contact portion 33, so as to increase the elasticity of the movable terminal 3. The front end side edge of the first fixing portion 31 is folded and extended downward with a first welding portion 34 being welded to the circuit board 200.

As shown in FIG. 1, the fixed terminal 4 is in a plate shape, arranged at the back end of the movable terminal 3, and has a second fixing portion 41. A second contact portion 42 is arranged above the second fixing portion 41, and may contact or disconnect from the first contact portion 33. The second fixing portion 41 is laterally folded and extended downward with a second welding portion 43 running through the side wall of the insulating body 1.

As shown in FIG. 1 to FIG. 4, during assembly, the signal terminals 2 are mounted in the second receiving slots 13, and the movable terminal 3 is mounted in the first receiving slot 12. The first receiving slot 12 and the second receiving slots 13 are respectively located at two sides of the insertion hole 11, and the length of the first receiving slot 12 extending backward is approximately equal to the length of the insulating body 1, so that the first receiving slot 12 is long. Further, the insulating arm 14 extends obliquely in the first receiving slot 12 into the insertion hole 11. Therefore, in the limited space of the first receiving slot 12, the length of the insulating arm 14 may also be kept large, so the elasticity is good.

As shown in FIG. 2, the electrical connector 100 is welded onto the circuit board 200 in a sinking manner, and multiple through-holes 210 are arranged on the circuit board 200, for the welding portions 24 to be inserted therein. Moreover, the abutting portion 25 butts a surface of the circuit board 200, and by adjusting the height of the abutting portion 25, the electrical connector 100 of different height standards may be manufactured.

Figure 7:
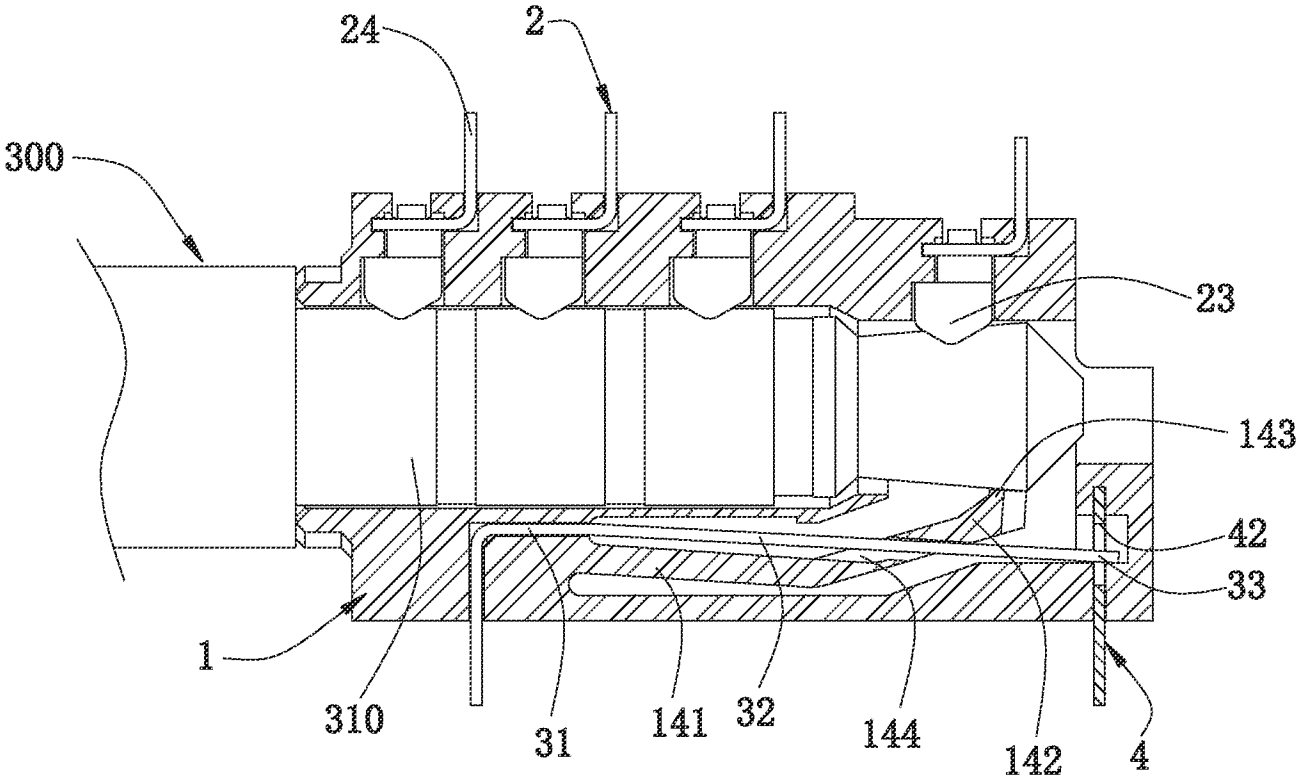
FIG. 7 is a schematic sectional view where an audio plug is inserted into the electrical connector according to one embodiment of the present invention.

As shown in FIG. 6 and FIG. 7, the electrical connector 100 is used for mating an audio plug 300. The audio plug 300 has four metal segments 310, which contact the four signal terminals 2 respectively and correspondingly. In the initial state, the first contact portion 33 of the movable terminal 3 contacts the second contact portion 42 of the fixed terminal 4, and the switch terminals are kept in a normally closed state. Alternatively, the location of the second contact portion 42 may also be changed as required, so in the initial state, the switch terminals are kept normally opened. When the audio plug 300 is inserted into the insertion hole 11, the audio plug 300 presses against the resisting portion 143, so that the insulating arm 14 moves toward a direction away from the insertion hole 11. The elastic arm 32 of the movable terminal 3 is limited by the groove 144, so the elastic arm 32 moves toward the direction away from the insertion hole 11 along with the insulating arm 14. Therefore, the first contact portion 33 is away from the second contact portion 42, so that the switch terminals are disconnected, so as to achieve the switching effect. Both the length of the insulating arm 14 and that of the movable terminal 3 are large, and the elasticity is good, so when the audio plug 300 is inserted into the insertion hole 11 multiple times and pushes the insulating arm 14, due to the good elasticity of the insulating arm 14, the insulating arm 14 is not broken, and effective displacements of the insulating arm 14 and the movable terminal 3 may be ensured, thereby ensuring switch-on/off of the switch terminals. Also, the distance between the first contact portion 33 and the first fixing portion 31 is greater than the length of the insulating arm 14, so when the movable terminal 3 moves, the displacement distance of the first contact portion 33 is greater than the displacement distance of the resisting portion 143, so that the contact or disconnection between the movable terminal 3 and the fixed terminal 4 may be comparatively sensitive.

To sum up, the electrical connector 100 according to certain embodiments of the present invention, among other things, has the following beneficial advantages.

(1) The insulating arm 14 extends to the inner side of the elastic arm 32 from the outer side of the elastic arm 32, and extends into the insertion hole 11 obliquely, so in the limited space of the first receiving slot 12, the length of the insulating arm 14 may be kept large, so the elasticity is good, and the insulating arm 14 is not broken after the audio plug 300 is inserted multiple times.

(2) Both the length of the insulating arm 14 and that of the movable terminal 3 are large, and the elasticity is good, so when the audio plug 300 pushes the insulating arm 14, effective displacements of the insulating arm 14 and the movable terminal 3 may be ensured, thereby ensuring switch-on/off of the switch terminal.

(3) The distance between the first contact portion 33 and the first fixing portion 31 is greater than the length of the insulating arm 14, so when the movable terminal 3 moves, the displacement distance of the first contact portion 33 is greater than the displacement distance of the resisting portion 143, so that the contact or disconnection between the movable terminal 3 and the fixed terminal 4 may be comparatively sensitive.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, having an insertion hole concavely formed from a front end surface of the insulating body, and a first receiving slot formed at a side of the insertion hole and in communication with the insertion hole;

an insulating elastic arm, extending from the insulating body, and having an extending portion partially entering the insertion hole;

a movable terminal, having a first fixing portion fixed in the insulating body, an elastic arm extending backward from the first fixing portion and located between the insertion hole and the insulating elastic arm, and a first contact portion extending backward from the elastic arm, wherein the first contact portion crosses the insulating elastic arm, and is located at a side of the insulating elastic arm away from the insertion hole; and a fixed terminal, having a second contact portion capable of keeping in contact with or disconnecting from the first contact portion.

2. The electrical connector according to claim 1, wherein the first fixing portion is fixed in the first receiving slot.

3. The electrical connector according to claim 1, wherein the insulating elastic arm has a base portion extending from a front inner wall surface of the first receiving slot, and an extending portion extending backward obliquely from the base portion, and the extending portion extends into the insertion hole.

4. The electrical connector according to claim 1, wherein a groove is disposed on the insulating elastic arm, and the elastic arm passes through the insulating elastic arm from the inside of the groove and is limited by the groove, such that the elastic arm is capable of moving along with the insulating elastic arm.

5. The electrical connector according to claim 1, wherein the distance between the first contact portion and the first fixing portion is greater than the length of the insulating elastic arm.

6. The electrical connector according to claim 1, wherein at least one bending portion is formed at the elastic arm or the first contact portion.

7. The electrical connector according to claim 1, further comprising multiple signal terminals, wherein each of the signal terminals is the same, and the signal terminals and the movable terminal are located at two opposite sides of the insulating body respectively.

8. An electrical connector, comprising:

an insulating body, having at least one first receiving slot, wherein the first receiving slot is internally and convexly disposed with an insulating elastic arm;

a movable terminal, having a first fixing portion fixed in the first receiving slot, an elastic arm extending backward from the first fixing portion, and a first contact portion located at a back end of the elastic arm, wherein the elastic arm passes through the insulating elastic arm, and is capable of moving along with the insulating elastic arm;

a fixed terminal, having a second contact portion capable of contacting the first contact portion; and multiple signal terminals, arranged in the insulating body.

9. The electrical connector according to claim 8, wherein the insulating body comprises an insertion hole in communication with the first receiving slot, the insulating elastic arm has a base portion extending from a front inner wall surface of the first receiving slot, and an extending portion extending backward obliquely from the base portion, and the extending portion extends into the insertion hole.

10. The electrical connector according to claim 9, wherein the elastic arm is located between the insulating elastic arm and the insertion hole, and the first contact portion crosses the insulating elastic arm and is located at a side of the insulating elastic arm away from the insertion hole.

11. The electrical connector according to claim 8, wherein a groove is disposed on the insulating elastic arm, and the elastic arm passes through the insulating elastic arm from the inside of the groove and is limited by the groove, such that the elastic arm is capable of moving along with the insulating elastic arm.

12. The electrical connector according to claim 9, wherein the elastic arm is located at an inner side of the insulating elastic arm, and the elastic arm extends backward from the first fixing portion, crosses the extending portion and extends to an outer side of the insulating elastic arm.

13. The electrical connector according to claim 8, wherein the distance between the first contact portion and the first fixing portion is greater than the length of the insulating elastic arm.

14. The electrical connector according to claim 8, wherein at least one bending portion is arranged on the elastic arm.

15. The electrical connector according to claim 8, wherein the signal terminals are all the same, and located at a same side of the insulating body.

* * * * *